United States Patent [19]

Strickland et al.

[11] Patent Number: 4,948,431

[45] Date of Patent: Aug. 14, 1990

[54] PATCH BINDER AND METHOD FOR ROAD SURFACE REPAIR

[76] Inventors: Paul D. Strickland, 2685 S. Dayton Way, Denver, Colo. 80231; Paul C. Doran, 13146 Warren Cir., Lakewood, Colo. 80228

[21] Appl. No.: 330,056

[22] Filed: Mar. 29, 1989

[51] Int. Cl.[5] ..... C08L 95/00

[52] U.S. Cl. ..... 106/273.1; 106/281.1; 106/278; 106/311; 427/136; 427/138; 427/140

[58] Field of Search ..... 106/273.1, 281.1, 278, 106/311; 427/136, 138, 140

[56] References Cited

U.S. PATENT DOCUMENTS 4,371,633 2/1983 Soltysk ..... 523/172

*Primary Examiner*—Paul Lieberman
*Assistant Examiner*—Helene Klemanski
*Attorney, Agent, or Firm*—John R. Flanagan

[57] ABSTRACT

A patch binder for road surface repair is capable of being sprayed under pressure onto existing road surfaces to foster seamless homogenizing and mending of existing road surface material with added asphalt patch material. The patch binder is composed of Toluene, Cyclohexanone, N-methylpyrrolidone, a surfactant and a black dye. It is non-hazardous to humans and to the environment, can be applied independent of weather and climate conditions, and lasts as long as the material of the road surface to which it is applied.

8 Claims, 1 Drawing Sheet

PATCH BINDER AND METHOD FOR ROAD SURFACE REPAIR

BACKGROUND OF THE INVENTION

1. Field of the Invention

The present invention generally relates to road surface repair and, more particularly, is concerned with patch binder capable of being sprayed under pressure onto a road surface to foster seamless homogenizing and mending of existing road surface material with added patch material.

2. Description of the Prior Art

Improvements in road construction have been a prerequisite to progress and growth of civilizations throughout history. The perpetual problem has been how to build and maintain a travelable roadway that will not break down from natural forces of weather and climate, or from use by man-made machines.

From roads constructed with wood blocks, cobble, rocks or brick to those built with macadam (asphalt concrete formed from stone and bitumen), tar, asphalt and concrete, the ever-present pot hole has been the nemesis of the road maintenance engineer. Expansion and contraction of the road surface due to the heat and drying effect of the sun and the coolness of the nights or the winter frost cause cracks and fissures to appear in the road surface into which water seeps, eventually leading to road destruction and wash-out.

With the demand for all-weather roads sparked by the automobile in the early decades of the twentieth century, rigid concrete highways (through the development of Portland cement) and variations of asphalt road material (through the development of the petroleum industry) began to spring up in the United States. By the latter half of this century, a nationwide interstate road system was initiated and developed.

Constant growth of the petroleum industry along with demands for petroleum asphalt products for road construction fostered continuous research into types of asphalt. Major improvements in road construction equipment and in the road and highway system itself were the outgrowth of the enormous development of asphalt and asphalt-related products. But, as the demand for improved road construction techniques continued to grow, so did the necessity for improvements in road repair and maintenance techniques. However, the latter has never kept pace with the progress of road building science. The pot hole still exists as both the symbol and the reality of this fact.

Over the years, many terms have been assigned to asphalt surfaced roads. There are many synonyms used colloquially and interchangeably. Although these materials and processes differ from one another, it is not unusual to hear the following terms used indiscriminately when describing a black road surface: macadam, blacktop, soft coat, road metal, asphaltic cement, bitumen (surface), shingle, asphalt surface, asphalt road, gilsonite, chip seal, tar, pitch road, paved-low type, pavement, road mix, hot/cold mix, flexible type, intermediate type, and many more.

Technically speaking, asphalt is a native mixture of hydrocarbons which occurs as an amorphous, viscous, brownish-black solid or semisolid. It results from the evaporation of the lighter hydrocarbons from petroleum and partial oxidation of the residue. (Petroleum asphalt differs from tar or pitch, which results from the destructive distillation of coal). Asphalt is insoluble in water, alcohol, acids and alkalies, but soluble in petroleum, chloroform, ether, acetone, carbon disulfide, and oil turpentine.

However, regardless of which descriptive term is applied to the road surface being discussed, the common denominator is that they all need repair. Depending on the type of road surface, the dressing and desiccation of moisture, the proper preparation and handling of the material, the weather and climate conditions, and the traffic type and flow, a road repair may last from only weeks to a few years until the same problem reappears.

Basically, there are two products that have been used previously in the maintenance and repair of road surfaces, one used much more widely than the other. The one product that has seen wide use is "liquid asphalt", commonly called "asphalt medium curing" or "tack oil" (which has carried the commercial designations: MC-30, MC-70, MC-250, MC-800, and MC-3000).

However, tack oil has many shortcomings making it less than an effective road surface repair product. In repairing pot holes or filling cracks in existing asphalt road surfaces, tack oil is strictly a "gluing" process or a "tacking" of new asphalt to the old. There is no homogeneous admixture of the new with the old asphalt. This repair leaves seams for water seepage and edges for mechanical displacement. It typically lasts only a few months because of the susceptibility to water seepage and the occurrence of road heaving. The old and new asphalt materials eventually separate and the original problem reoccurs.

Further, weather and climate conditions must be near "perfect" for application of tack oil, which at best allows for only a minimal time until replacement again is necessitated. Tack oil cannot be used in cold or wet weather or on wet surfaces. Also, tack oil repair of road surfaces requires a multiple highway crew to apply the asphalt and the use of expensive equipment. The tack oil must be pre-heated to 250 degrees F. for 2–3 hours before application, then applied and rolled or tamped in place to form a smooth surface.

The other product which has seen limited use in the maintenance and repair of road surfaces is called "asphalt bond" (which has carried the commercial designations: H-55 and H-88). Asphalt bond is a chemical formulation of: (1) Toluol or Toluene, Cyclohexanol, N,N-Dimethylforamide (DMF), and petroleum soap or surfactant. It is a clear, water-white liquid used for hot asphalt repair bond only. Its chemical formulation is changed (and commercial designation is changed to C-55) by removal of the chemical DMF for cold weather asphalt repair application.

Asphalt bond does promote seamless homogenizing and mending of existing road surface material with added patch material. However, its DMF constituent is a known hazardous chemical both to human health and the environment. Thus, asphalt bond is unsuitable under governmental regulatory health and safety standards for use in road surface repair applications in particular and in spray applications in general.

Consequently, a long-felt need still exists for a product effective in road surface repair applications, whose use is not contingent on weather and climate conditions and does not require extensive equipment to apply it. At the same time, the product must meet all applicable regulatory health and safety standards.

SUMMARY OF THE INVENTION

The present invention provides a road patch binder and repair method designed to satisfy the aforementioned needs. The patch binder of the present invention addresses and resolves the above-described problems of road surface repair and maintenance and avoids the drawbacks of the prior art products. It is a viscous black liquid capable of being sprayed from a pressure hose. Its application to road surfaces is neither equipment nor labor intensive.

The patch binder of the present invention is composed of five chemical constituents: Toluene, Cyclohexanone, N-methylprrolidone (NMP), a surfactant, and a black dye. Although its uses are similar to the prior art asphalt bond, the chemical formulation of patch binder is different: only three of its chemical constituents were used in the prior art asphalt bond. Unlike the prior art asphalt bond, the patch binder of the present invention softens and penetrates the existing asphalt to create a mending process through homogenizing of the existing asphalt with added asphalt patch material, in either hot or cold state independent of weather and climate conditions, creating a single mass of road surface without seams. Further, unlike the prior art asphalt bond, the patch binder of the present invention is not hazardous to either human health or the environment, is suitable under applicable regulatory health and safety standards for use in road surface repair applications, and can be applied as a spray.

The present invention also relates to a method of repairing a pot hole or a crack in a road surface. The repairing method comprises the steps of: (a) providing a liquid repair patch binder in the form of the above-defined mixture; and (b) applying, such as by spraying, the liquid repair binder on the exposed pot hole or crack and the road surface edge surrounding the same. In repairing a wide crack or a pot hole, the method also comprises the further step of filling and consolidating a repair patch material in the crack or pot hole.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
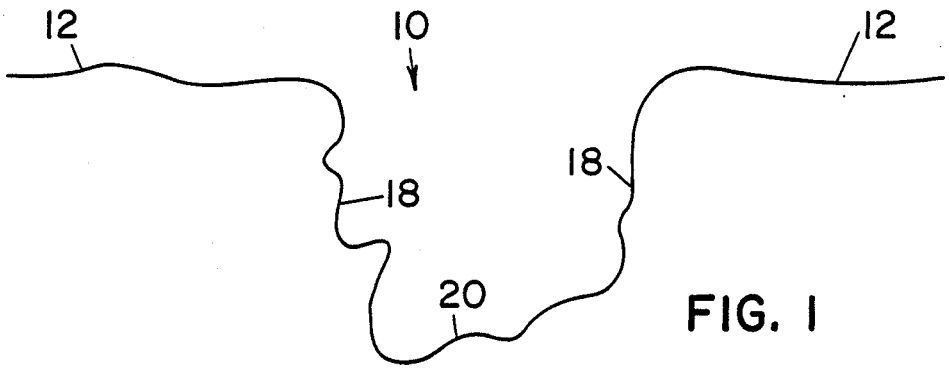
FIG. 1 is a schematical representation of an existing road surface containing a pot hole.
Figure 2:
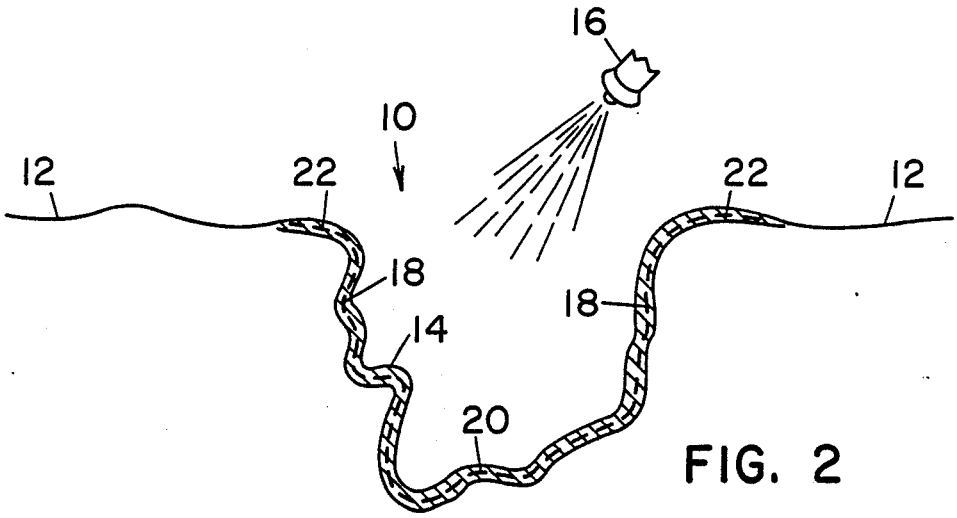
FIG. 2 is a schematical representation of the existing road surface and pot hole of FIG. 1 with the patch binder of the present invention applied thereto.
Figure 3:
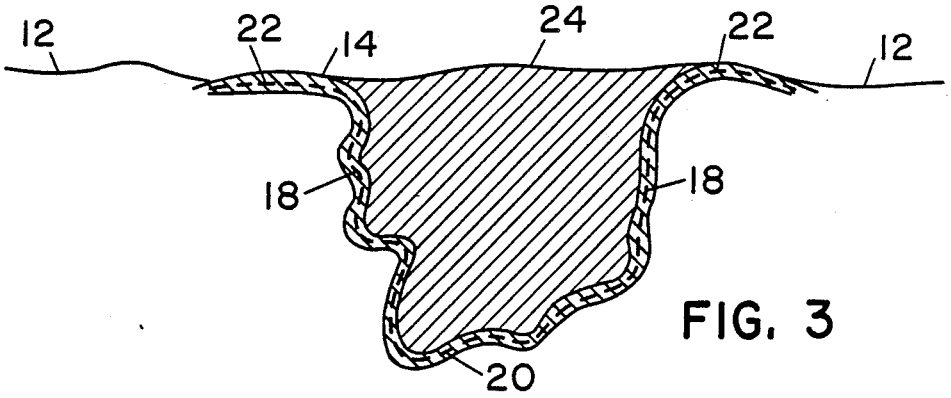
FIG. 3 is a schematical representation of the existing road surface and pot hole of FIG. 1 with the patch binder applied thereto as seen in FIG. 2 and with added repair asphalt filling the pot hole and covering the patch binder to provide seamless homogenizing and mending of the old asphalt with the added repair asphalt.

Referring now to the drawings, and particularly to FIG. 1, there is shown a typical pot hole 10 in a road surface 12. The patch binder of the present invention, as schematically represented at 14 in FIG. 2, is highly advantageous in its ability to promote repair of pot holes, such as the pot hole 10 in the road surface 12 depicted in FIG. 1. However, it can be used on other surfaces, such as curbs and gutters, parking lots, driveways, airport runways and roofs, as an asphalt crack filler, curb and gutter bonder and sealer, road overlay, concrete joint filler, soil sealant to inhibit seepage, and roof patch.

The patch binder 14 is a viscous black liquid capable of being sprayed from a pressure hose 16 on the surface to be repaired. For instance, as represented in FIG. 2, it is sprayed on the sides 18 and bottom 20 of the pot hole 10 and the edges 22 of the original road surface 12 surrounding the pot hole 10. When applied to the existing asphalt of the pot hole 10 and road surface 12, the patch binder 14 softens and penetrates the asphalt. Then, when either hot or cold asphalt patch material 24 is added to fill the pot hole 10 and overlap the road surface edge 22, the patch binder 14 fosters a mending process through homogenizing of the existing asphalt with the added patch asphalt, creating a single mass of reconstituted road surface without seams.

The patch binder 14 of the present invention is composed of the chemical constituents listed in Table I. The CAS numbers and preferred approximate proportions in percentage by weight of the chemical constituents are also given in the table.

TABLE I

| Chemical Constituent | CAS # | Percentage |
|---|---|---|
| Toluene | 108-88-3 | 67 |
| Cyclohexanone | 108-91-1 | 13 |
| N-methylpyrrolidone (NMP) | 872-50-4 | 13 |
| Surfactant (C40 or A24 or equiv. Pet. Soap) | | 5 |
| Black dye | | 2 |

(The percentages by weight of the chemical constituents can vary within a range which includes the preferred listed percentages. For example, Toluene, from 64 to 70; Cyclohexanone, from 12 to 14; N-methylpyrrolidone, from 12 to 14; the surfactant, from 4.5 to 5.5; and the black dye, from 2 to 3.

The Toluene constituent is a chemical solvent, typically used in glues, paints, fingernail polish remover, and cleaning fluids. It is an aromatic hydrocarbon, also known as methylbenzol, methylbenzene and phenylmethane.

The Cyclohexanone constituent is a low cost solvent, typically used in lacquers, resins and insecticides, and also used for metal degreasing. It is also known as pimelic ketone, cyclohexol ketone and ketohexamethylene.

The N-methylpyrrolidone (NMP) constituent is a solvent used extensively in chemical processing, particularly in petroleum refining. It is also important as a solvent in agricultural chemical formulation and is used as a chemical intermediate in the pharmaceutical industry and used in the cosmetic industry as a vehicle and to promote penetration of other compounds into the formulation.

The Surfactant constituent increases wetability and miscibility of chemicals and brings mixture to volume.

The Black Dye constituent is a compatible black petroleum product, such as liquid asphalt, to create a black color to an otherwise clear formulation. This is necessary for maintaining familiarity and acceptance by end users having years of experience associating asphalt roadways with a black color as well as for allowing visualization of the spray from a hose onto the applied surface.

In addition to pot hole repair, the patch binder 14 can be used to repair, i.e., seal, cracks in road surfaces and other surfaces (mentioned earlier) also. The repair is carried out merely by applying the liquid repair binder on the exposed crack and on the road surface edge surrounding the crack. Depending on the width of the crack, it may or may not need to be filled with a repair patch material.

To recapitulate, the features and advantages of the patch binder of the present invention are as follows: (a) non-hazardous to human beings and to the environment by spraying, atomizing, dripping, pouring, or the like onto a repair surface; (b) has long life on the road surface, lasting indefinitely, as long as the original asphalt surface; (c) homogenizes into existing asphalt surface to allow no seams, with the edges of repair asphalt (hot or cold) feathered into existing road surface; (d) does not permit water or moisture to undermine the repair hot or cold asphalt due to lack of seams or edges; (e) can be used in all temperatures and with either hot asphalt or cold asphalt repair material; (f) needs minimal to no road dressing or desiccation of moisture; (g) requires minimum work crew of 1–2 workers for application; (h) requires no preheating to apply; (i) requires no expensive equipment, does not need heating or boiler equipment, and eliminates propane heating gas; and (j) minimizes total expense in manpower and equipment.

It is thought that the resent invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely preferred or exemplary embodiment thereof.

Having thus described the invention, what is claimed is:

1. A mixture for use as a repair patch binder, comprising:

(a) Toluene, in the percentage by weight range of 64 to 70;

(b) Cyclohexanone, in the percentage by weight range of 12 to 14;

(c) N-methylpyrrolidone, in the percentage by weight range of 12 to 14;

(d) a surfactant, in the percentage by weight range of 4.5 to 5.5; and (e) a black dye, in the percentage by weight range of 2 to 3.

2. The mixture as recited in claim 1, wherein said chemical constituents of said repair patch binder are in the following approximate percentages by weight: Toluene-67; Cyclohexanone-13; N-methylpyrrolidone-13; the surfactant-5; and the black dye-2.

3. A method of repairing a pot hole in a road surface, comprising the steps of:

(a) providing a liquid repair patch binder in the form of a mixture having the chemical constituents, Toluene, Cyclohexanone, N-methylpyrrolidone, a surfactant, and a black dye;

(b) spraying the liquid repair patch binder on the exposed surface of the pot hole and road surface edge surrounding the pot hole; and (c) filling and consolidating in the pot hole a repair patch material.

4. The repairing method as recited in claim 3, wherein said chemical constituents of said liquid repair patch binder are in the following percentages by weight ranges: Toluene, from 64 to 70; Cyclohexanone, from 12 to 14; N-methylpyrrolidone, from 12 to 14; the surfactant, from 4.5 to 5.5; and the black dye, from 2 to 3.

5. The repairing method as recited in claim 4, wherein said chemical constituents of said liquid repair patch binder are in the following percentages by weight: Toluene-67; Cyclohexanone-13; N-methylpyrrolidone-13; the surfactant-5; and the black dye-2.

6. A method of repairing a crack in a road surface, comprising the steps of:

(a) providing a liquid repair patch binder in the form of a mixture having the chemical constituents, Toluene, Cyclohexanone, N-methylpyrrolidone, a surfactant, and a black dye; and (b) applying the liquid repair binder on the exposed crack and the road surface edge surrounding the crack.

7. The repairing method as recited in claim 6, further comprising the step of:

(c) filling and consolidating in the crack a repair patch material.

8. The repairing method as recited in claim 6, wherein said chemical constituents of said liquid repair binder are in the following percentages by weight ranges: Toluene, from 64 to 70; Cyclohexanone, from 12 to 14; N-methylpyrrolidone, from 12 to 14; the surfactant, from 4.5 to 5.5; and the black dye, from 2 to 3.

* * * * *